US005910758A

United States Patent [19]

Maloney et al.

[11] Patent Number: 5,910,758

[45] Date of Patent: Jun. 8, 1999

[54] MINIATURE CIRCUIT BREAKER WITH SHUNT TRIP DEVICE

[75] Inventors: James G. Maloney, Industry; Stephen A. Mrenna, Beaver, both of Pa.

[73] Assignee: Eaton Corporation, Cleveland, Ohio

[21] Appl. No.: 08/986,346

[22] Filed: Dec. 8, 1997

[51] Int. Cl.[6] ..... H01H 75/10

[52] U.S. Cl. ..... 335/35; 335/38

[58] Field of Search ..... 335/35–38, 41, 335/23–25, 167–176

[56] References Cited

U.S. PATENT DOCUMENTS

| | | | |
|---|---|---|---|
| 3,179,767 | 4/1965 | Middendorf | 335/41 |
| 3,258,562 | 6/1966 | Hurtle | 335/35 |
| 3,278,708 | 10/1966 | Casey et al. | 335/35 |
| 3,421,123 | 1/1969 | Johnson et al. | 335/35 |
| 3,849,747 | 11/1974 | Mrenna et al. | 335/166 |
| 3,959,754 | 5/1976 | Mrenna | 335/35 |
| 5,546,060 | 8/1996 | Mrenna | 335/35 |

*Primary Examiner*—Lincoln Donovan
*Attorney, Agent, or Firm*—Martin J. Moran

[57] ABSTRACT

A circuit breaker system with a shunt trip device is taught in which the shunt trip device occupies a miniature circuit breaker case and utilizes features of the miniature circuit breaker case except that it is provided with a coil and two-piece armature which initiates the shunt tripping operation when properly energized to thus open the separable main contacts of side-by-side mounted circuit breakers having the same intermediate axial member. A back plate is provided for the two-piece joined armature member in the central region of the toroid, solenoid or coil to assist the snug fit of the two-piece core within the central opening of the bobbin of the solenoid and to provide a low reluctance bypass for the magnetic flux crossing the gap formed by the end abutments of the two-pieces of the magnetic core.

14 Claims, 3 Drawing Sheets

MINIATURE CIRCUIT BREAKER WITH SHUNT TRIP DEVICE

BACKGROUND OF THE INVENTION

1. Field of the Invention

The subject matter of this invention relates to miniature circuit breakers and in particular to shunt trip devices for miniature circuit breakers.

2. Description of the Prior Art

Miniature circuit breakers with remotely controlled solenoid coils for turning the circuit breaker on and off are well know in the art. An Example of this may be found in U.S. Pat. No. 4,625,190 entitled "Remotely Controlled Solenoid Operated Circuit Breaker" by Wafer et al., issued Nov. 25, 1986; and U.S. Pat. No. 4,725,799 entitled "Circuit Breaker with Remote Control" by Bratkowski et al., issued Feb. 16, 1988. The solenoid in the aforementioned circuit breaker may be energized to trip the circuit breaker by way of a plunger. However actuation of a circuit breaker into the tripping mode with the utilization of a plunger requires a relatively large circuit breaker because of the space taken up by the solenoid and plunger.

Smaller, miniature circuit breakers not having solenoid operated tripping mechanism are also well known the art. An example of this can be found in U.S. Pat. No. 3,849,747 entitled "Circuit Breaker with Handle Indicating Means" issued to Mrenna et al., on Nov. 19, 1974; and U.S. Pat. No. 3,959,754 entitled "Circuit Breaker with Improved Trip Means" issued to Mrenna on May 25, 1996. These circuit breakers are generally relatively narrow and may be, for example, one-half inch wide. They do not have to accommodate the previously described solenoids. They do perform the normal thermal tripping operation by utilizing a bimetal actuator for lower level overloads and a magnetic armature for higher level overloads.

A shunt trip device for a miniature circuit breaker may include a non-overload actuable miniature circuit breaker case that is stacked side-by-side with one or more operating circuit breakers. The shunt trip coil is disposed on the non-actuable circuit breaker magnetic core and is interconnected with external shunt trip actuating leads. There is no thermal or magnetic tripping capability in the non-actuable circuit breaker coil. All of the side-by-side circuit breakers have a common trip mechanism arm, rotating shaft so that if one is tripped open the others open automatically whether the tripping action is caused by a thermal trip in one of the active circuit breakers, or a magnetic trip in one of the active circuit breakers or a shunt trip in the shunt trip device.

It would be advantageous if a shunt trip device could be found and utilized within a relatively narrow, for instance ½ inch, miniature circuit breaker case which is ganged in side-by-side relationship with actual circuit breakers. It would be further advantageous, if the basic circuit breaker mechanism could be quickly modified to produce the shunt trip device without the necessity of having to design a completely separate shunt trip mechanism.

SUMMARY OF THE INVENTION

In accordance with the invention a circuit breaker system including a shunt trip device is taught. The trip device interacts with separable main contacts of circuit breakers for opening the separable main contacts thereof. The trip device is actuated by a movable latch. A movable armature is provided which interacts with movable latch for capturing a portion of the movable latch until the movable armature is moved at which time the movable latch releases. An electromagnetic device interacts with a movable armature to move it. An electromagnetic toroidal coil is provided which has a central opening. Into the central opening is placed a two-piece magnetic core, which is magnetized by the toroidal coil. A controllable source of electrical power is interconnected with the toroidal coil for magnetizing the two-piece magnetic core upon command. This actually ultimately leads to the shunt trip actuation. The toroidal coil may have a bobbin and the two-piece magnetic core may comprise of pair of members which are end abutted to allow assembly from both sides of the central opening of the toroidal coil and associated bobbin. The members may be L-shaped in cross-section, where each of the L-shaped members has a long leg and a short leg. The long legs may be slanted at the ends to prevent abutment at the wrong ends. Furthermore a backing plate may be provided which overlaps the abutted ends in magnetic parallel relationship to conduct magnetic flux lines more easily therethrough. The back plate may help to secure the two-piece magnetic core means within the bobbin.

DESCRIPTION OF THE PREFERRED EMBODIMENT

Figure 1:
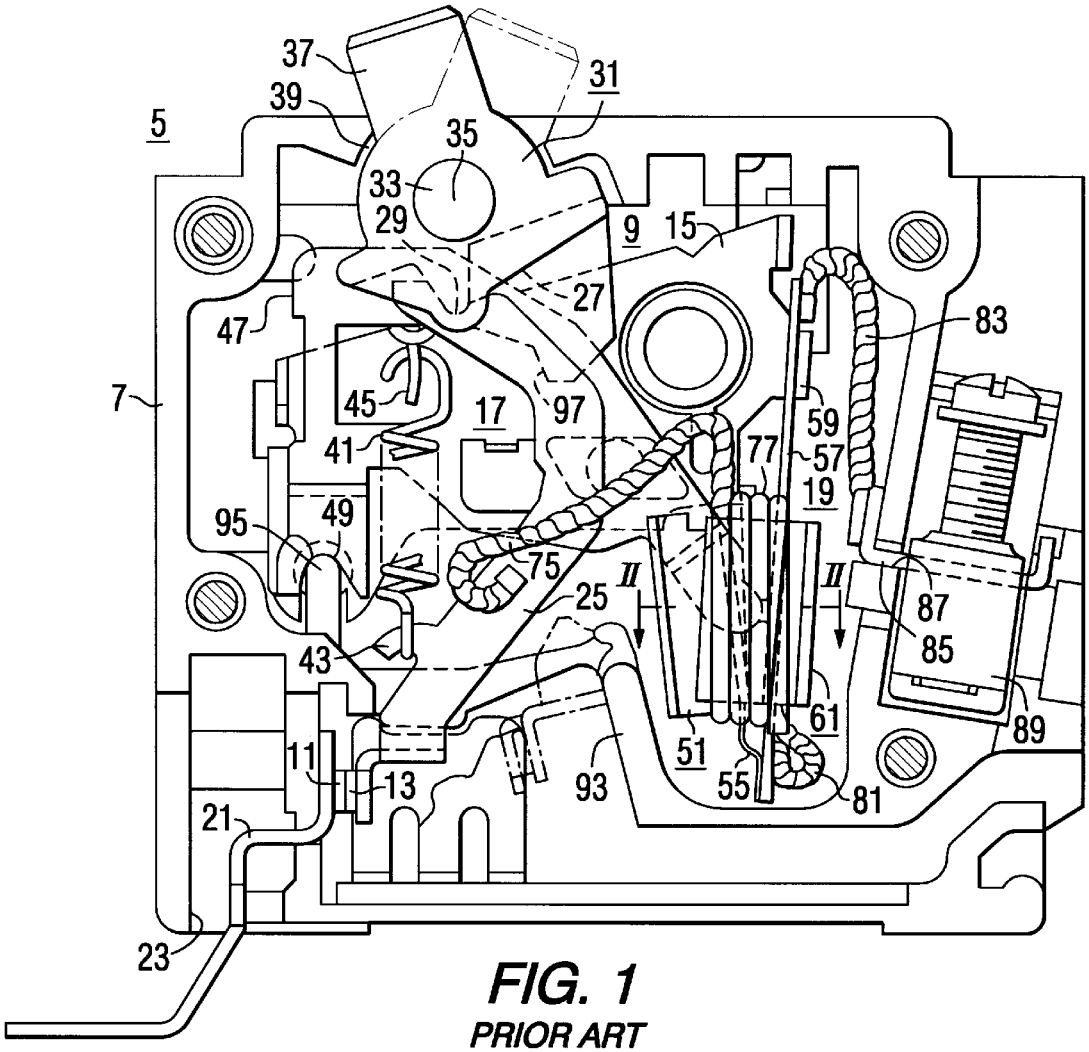
FIG. 1 PRIOR ART
FIG. 1 is a side elevation view, partially in section, of a prior art miniature circuit breaker.
Figure 2:
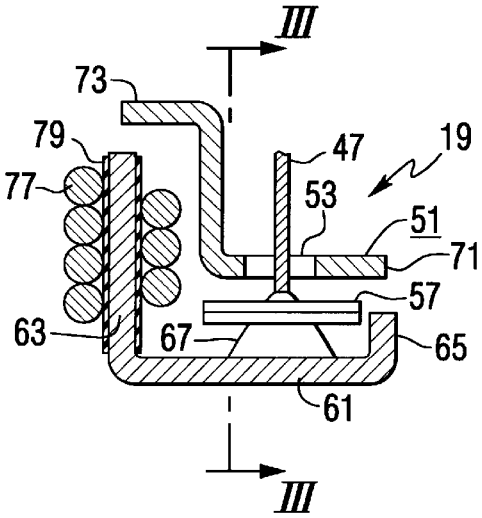
FIG. 2 PRIOR ART
FIG. 2 is a partial sectional view taken generally along the line II—II of FIG. 1.
Figure 3:
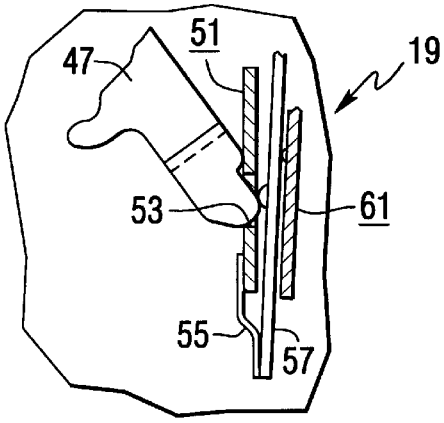
FIG. 3 PRIOR ART
FIG. 3 is a partial sectional view taken generally along the line III—III of FIG. 2.

Referring to FIGS. 1–3 of the drawings, there is disclosed therein a prior art circuit breaker 5 comprising an insulating housing 7. The circuit breaker mechanism 9 comprises a stationary main contact 11, a movable main contact 13, a supporting metal frame 15, an operating mechanism 17 and a thermal and magnetic trip means 19.

The stationary contact 11 is supported on a conducting terminal 21 that extends out through an opening in the bottom of the housing. The movable contact 13 is supported on one end of a contact arm 25. The contact arm 25 is provided with a depression or bearing surface 27 at its upper end that receives a generally V-shaped bearing part 29 of an insulating operating member 31. The operating member 31 is provided with a pair of molded bearing pins 33 at its opposite sides which fit into suitable openings in the insulating housing 7 to pivotally support the operating member 31 for movement about an axis indicated at 35. The operating member 31 is provided with a handle part 37 that extends out through an opening 39 in the front of the housing to permit manual operation of the circuit breaker. An over center tension spring 41 is supported at its lower end on a projection 43 of the contact arm 25 and at its upper end on a projection 45 of a releasable trip member 47. The releasable trip member 47 is pivotally supported at one end thereof by a molded portion 49 of the insulating house 7. The releasable trip member 47 is latched at its other end on a magnetic armature 51. As is best seen in FIGS. 2 and 3, the armature 51 is provided with a window opening therein having a latch surface 53 at the lower ledge of the window opening. The releasable member 47 engages the latch surface 53 (FIGS. 1–3) and the latched position of the releasable member. As is best seen in FIG. 3, the armature 51 is supported on a leaf spring 55 that is in turn supported on a bimetal 57 whereby the armature 51 is movable supported on the bimetal 57. The bimetal 57 (FIG. 1) is fixedly supported at its upper end on a bent-over projection 59 of the supporting frame 15. A generally U-shaped magnetic yoke 61, comprising a long leg 63 and a short leg 65 (FIG. 2) is fixedly supported on the bimetal 57 by means of a weld 67. As can be understood with reference to FIG. 2, the armature 51 is generally Z-shaped with a lower leg 71 having the window opening therein and having a portion disposed opposite the short leg 65 of the yoke 61 and with an upper leg 73 having a portion disposed opposite the long leg 63 of the yoke 61. A flexible conductor 75 (FIG. 1) is connected at one end thereof to the contact arm 25 and at the other end thereof to a coil 77 that provides a plurality of turns around the long leg 63 of the magnetic yoke 61. The coil 77 is provided with a thin layer of insulation to insulate the turns from each other and the coil is also insulated from the leg 63 of the magnetic yoke by means of an insulating member 79 that is disposed between the coil 77 and the leg 63. A flexible conductor 81 (FIG. 1) is secured at one end thereof to the other end of the coil 77 and at the other end thereof to the bottom of the bimetal 57. Another flexible conductor 83 is secured at one end thereof to the top of the bimetal 57 and at the other end thereof to a conductor 85 that protrudes through an opening 87 in the housing and to which is secured a solderless terminal connector 89 that will receive a conductor at a installation to enable connection of a conducting wire to the circuit breaker.

The circuit through the breaker extends from the terminal conductor 21 through the stationary contact 11, movable contact 13, contact arm 25, flexible conductor 75, coil 77, flexible conductor 81, bimetal 57, flexible conductor 83, conductor 85, to a conductor that would be connected to the breaker by means of the solderless terminal connector 89 at an installation.

With the releasable member 47 in the latched position shown in FIGS. 1–3, the circuit breaker may be manually operated to open and close the contacts by operation of the operating handle 37 of the insulating operating member 31. Movement of the handle 37 clockwise from the full line position shown in FIG. 1 to the position in which it is shown in dot-and-dash lines carries the upper end of the contact arm 25 to the left of the line of action of the spring 41 whereupon the spring 41 acts to move the contact arm 25 with a snap action to the open position shown partially in dot-and-dash lines in FIG. 1. A projection 93 molded integral with the housing 7 acts as a limit stop for the movable contact arm 25 during opening operations. Movement of the handle 37 in a counterclockwise direction from the position shown in dot-and-dash lines in FIG. 1 to the full line position moves the upper end of the contact arm 25 to the right of the line of action of the spring 41 which spring thereupon acts to move the contact arm to the closed position with a snap action.

Upon the occurrence of a sustained lesser overload current above a first predetermined value, the bimetal 57 becomes heated and deflects to the right to effect a time delayed thermal tripping operation. The armature 51, which is supported on the bimetal 57 by means of the spring 55, is carried to the right with the bimetal 57 to release the releasable member 47. When the releasable member 47 is released, the spring 41 acts to rotate the releasable member clockwise on the post 49 about an axis indicated at 95 until this motion is arrested by engagement of the releasable member 47 with the molded part 93 of the insulating housing 7. During this movement, the spring 41 moves the contact arm 25 to the open position and the operating member 31 to a position intermediate on the "on" and "off" positions to provide a visual indication that the circuit breaker has tripped open.

Before the contacts can be closed following an automatic tripping operation it is necessary to reset and relatch the mechanism. This is accomplished by moving the operating handle 37 clockwise from the intermediate position to a position slightly beyond the full open or "off" position. During this movement, due to the engagement of a downwardly extending position 97 of the operating member 31 with the bent-over projection 45 of the releasable member 47, the releasable member 47 is moved counterclockwise about the axis 95 until the end of the releasable member 47 is again latched in the window opening on the latch surface 53 (FIGS. 2 and 3) of the armature 51. Following a resetting operation the circuit breaker can be manually operated in the same manner as was hereinbefore described.

The circuit breaker is magnetically tripped automatically and instantaneously in response to overload currents above the second predetermined value higher than the first predetermined value. As was hereinbefore described, the circuit through the circuit breaker extends through the turns of the coils 77 around the long leg 63 of the magnetic yoke 61 and the through the bimetal 57. The magnetic flux, which is induced around the conductor 77 and bimetal 57, takes the path of least reluctance through the magnetic yoke 61, across the air gaps between the ends of the legs 63, 65 and the armature 51. When an overload current above the second predetermined value occurs, the pull of the magnetic flux is of such strength that the armature 51 is instantaneously attracted to the yoke 61 whereupon the spring 55 flexes permitting the armature 51 to move to the right to release the releasable member 47 whereupon the circuit breaker is tripped open in the same manner as was hereinbefore described with regard to the thermal tripping operation. Following a magnetic tripping operation the circuit breaker is reset and relatched in the same manner as was hereinbefore described.

U.S. Pat. No. 3,959,754 is incorporated herein by reference to show the operating mechanism of the shunt tripped device which is to be described hereinafter.

U.S. Pat. No. 5,546,060 entitled "Support Plate for a Circuit Breaker" issued to Mrenna on Aug. 13, 1996 is also incorporated herein by reference to show the miniature circuit breaker molded case of the presence invention. In the embodiment of the invention depicted in FIGS. 4 through 7 a circuit breaker apparatus similar to that shown and described in the incorporated-by-reference patents are utilized and modified to form a basic building block for a shunt trip apparatus. In the embodiments which follow, the basic thermal and magnetic circuit tripping activity is bypassed.

Figure 4:
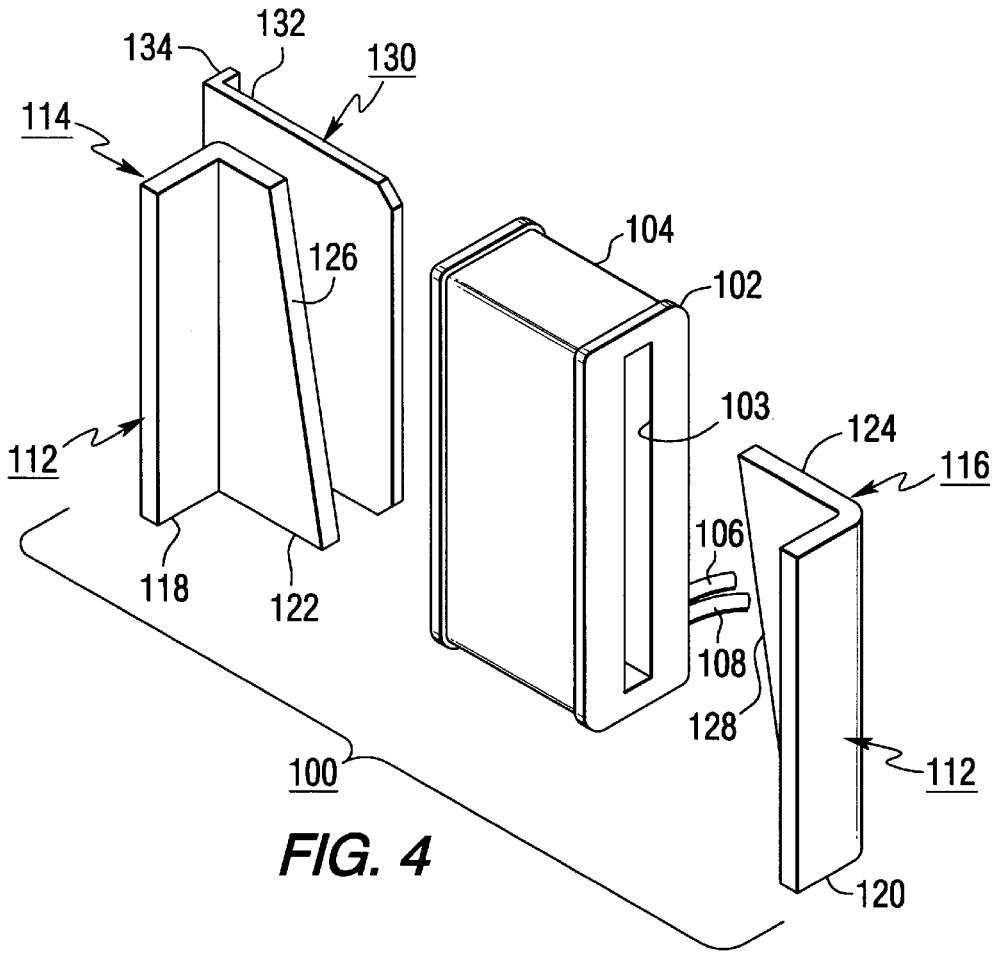
FIG. 4 is an exploded view of a two-piece armature, bobbin, coil and back plate arrangement incorporating the present invention.
Figure 5:
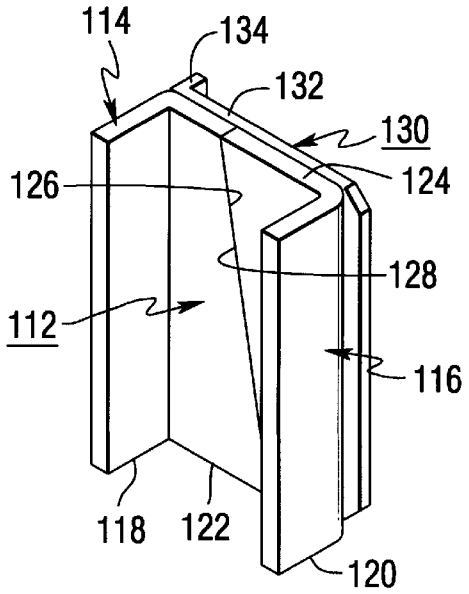
FIG. 5 is a view similar to that shown in FIG. 4 but with the two-piece armature means and back plate shown joined.
Figure 6:
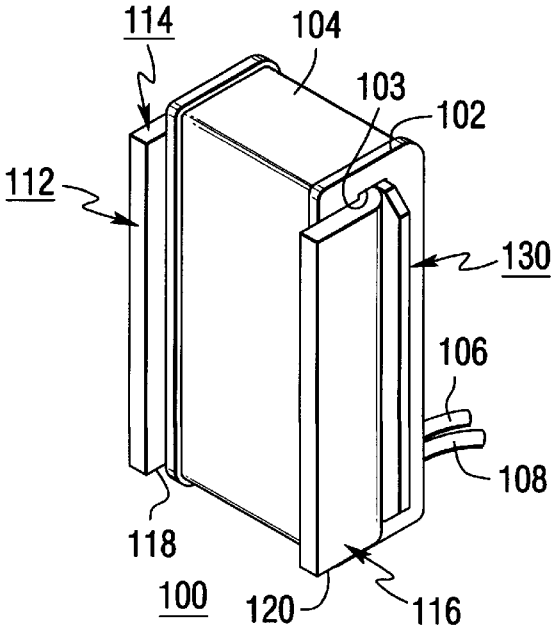
FIG. 6 is a view similar to FIGS. 4 and 5 but with the bobbin and coil shown disposed around the two-piece armature and back plate.
Figure 7:
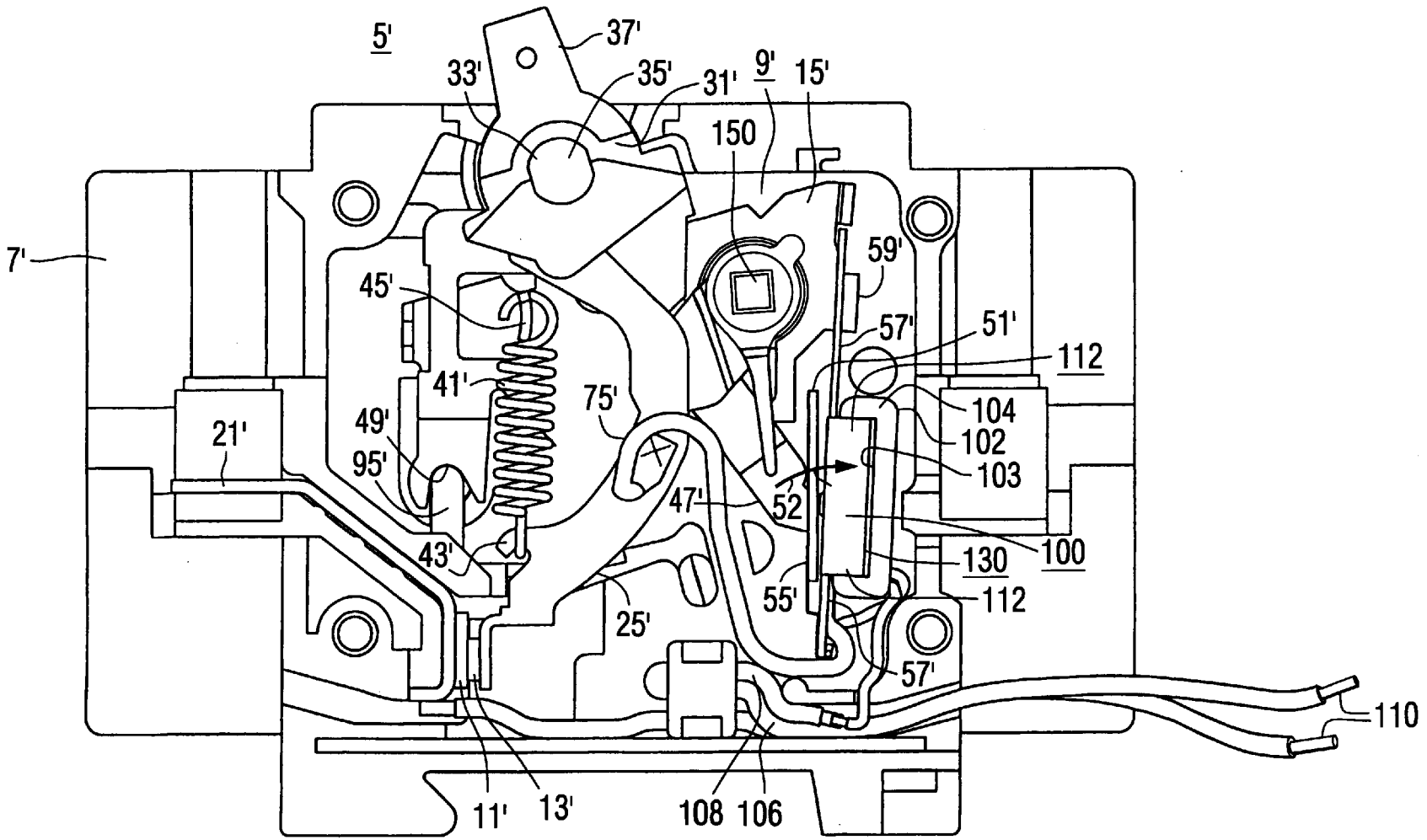
FIG. 7 shows an arrangement similar to that shown in FIG. 1 but with the apparatus of FIGS. 4 through 6 disposed therein and utilizing a shunt trip actuating device and a slightly different case arrangement.

Referring now to FIGS. 4, 5 and 6, shunt trip device 100 for a circuit breaker system is shown. Device 100 includes a two-piece magnetic core 112 comprising a first piece 114 and second piece 116. Piece 114 is generally of L-shaped cross-section having a short leg 118. Piece 116 is also of L-shaped cross-section having a short leg 120. Piece 114 has long leg 122 and piece 116 has a long leg 124. The abutting end portions 126 and 128 respectively of piece 114 and 116 are joined or end abutted as best shown in FIG. 5. Because of the slanted end portions 126 and 128 the pieces 112 will only go together in one way without producing slanted end walls. That is the way shown in FIG. 5. There is also provided a mandrel or bobbin 102 having a central opening 103 upon which is wound on electromagnetic toroidal coil 104 which is empowered by way of lead lines or conductors 106 and 108 which are connected to a source of electric power 110 as best shown in FIG. 7. There is provided a back support piece 130 having an elongated section 132 and a short perpendicular leg 134. The support overlapping piece 130 with the fully jointed structure 112 is best shown in FIG. 5. Because of the presence of the slanted air-gap formed by the abutting edged or ends 126 and 128, piece 130 represents a fully magnetically conducting, overlapping magnetic flux alternative path across the back of the armature 112. The short lip, ear or leg 134 prevents translational lateral or side-ways motion of the piece 130 when disposed in the opening 103 of the mandrel or bobbin 102 as is best shown in FIG. 6.

Referring now to FIG. 7 the disposition of the magnetic shunt trip arrangement 100 within the shunt trip apparatus 5' is shown. The case 7', as was mentioned previously, is similar to the case shown and described in U.S. Pat. No. 5,436,604 and the operating mechanism is shown and described in U.S. Pat. No. 3,959,754. For purposes of simplicity of illustration the reference symbols utilized in incorporated by reference U.S. Pat. No. 3,959,754 are utilized in showing and describing the mechanism for the presence application with like members having like numbers except for the presence of the prime (') in each case.

Operation

In operation, leads 108 and 106 are provided with source of energy 110 which empowers the coil 104 to magnetize or produce magnetic flux in the two-piece magnetic core 112 which reacts with the movable facing armature 51' to rotate it to the right (clockwise) in the direction 52 to release the previously captured latch 47' to cause the separable main contacts 11' and 13' to open, but more importantly to cause the common shaft 150 to rotate in the side-by-side attached circuit breakers to cause the separable main contacts of those circuit breakers to open in response to the shunt tripping action provided by the device 5'. It is to be noted with respect to this embodiment of the invention, that no load or lead line are provided to the shunt trip device 5'. Furthermore, the bimetal 57' will not actuate under thermal overload conditions to cause a circuit breaker tripping action nor will the armature 51 be drawn towards the armature 50 in the direction 52 due to excessive line or load circuit as there is no line or load circuit flowing in shunt trip device 5'. The only thing which will cause the armature 51 to move toward the armature 52 is the energization to the lines 106 and 108 by the application of power at 110.

What we claim as our invention is:

1. A circuit breaker system with a shunt trip device, comprising:

separable main contacts;

trip means interactive with said separable main contacts for opening said separable main contacts;

movable latch means interconnected with said trip means for actuating said trip means upon release;

movable armature means interactive with said movable latch means for capturing said movable latch means until said movable armature means is moved at which time said movable latch means is released;

electromagnetic means interactive with said movable armature means for moving said movable armature means when said electromagnetic means is energized, comprising;

electromagnetic toroidal coil means having a central opening;

two piece magnetic core means disposed within said central opening for being magnetized by said electromagnetic toroidal coil means for interacting with said movable armature means for moving said movable armature means;

a source of electrical power interconnected with said electromagnetic toroidal coil means upon command for magnetizing said two piece magnetic core means; and wherein said two piece magnetic core means comprises a pair of members which are end abutted at the end of a leg of each to allow assembly from both sides of said central opening.

2. The combination as claimed in claim 1, wherein said each of said pair of members is L shaped.

3. The combination as claimed in claim 2, wherein said each of said pair of L shaped members has a long leg and a short leg.

4. The combination as claimed in claim 1, wherein said legs which are end abutted are shaped at said ends in a slanted direction to prevent abutment at wrong ends.

5. The combination as claimed in claim 2, wherein said each of said pair of L shaped members has a long leg and a short leg, wherein said legs which are end abutted are said long legs.

6. The combination as claimed in claim 3, wherein said long legs are end abutted and said short legs face said movable armature means.

7. A circuit breaker system with a shunt trip device, comprising:

separable main contacts;

trip means interactive with said separable main contacts for opening said separable main contacts;

movable latch mean interconnected with said trip means for actuating said trip means upon release;

movable armature means interactive with said movable latch means for capturing said movable latch means until said movable armature means is moved at which time said movable latch means is released;

electromagnetic means interactive with said movable armature means for moving said movable armature means when said electromagnetic means is energized, comprising;

electromagnetic toroidal coil means having a central opening;

two piece magnetic core means disposed within said central opening for being magnetized by said electromagnetic toroidal coil means for interacting with said movable armature means for moving said movable armature means; and a source of electrical power interconnected with said electromagnetic toroidal coil means upon command for magnetizing said two piece magnetic core means;

a bobbin means for supporting said electromagnetic toroidal coil means; and wherein said two piece magnetic core means comprises a pair of members which are end abutted at the end of a leg of each to allow assembly from both sides of said central opening.

8. The combination as claimed in claim 7, wherein said each of said pair of members is L shaped.

9. The combination as claimed in claim 8, wherein said each of said pair of L shaped members has a long leg and a short leg.

10. The combination as claimed in claim 7, wherein said legs which are end abutted are shaped at said ends in a slanted direction to prevent abutment a wrong ends.

11. The combination as claimed in claim 8, wherein said each of said pair of L shaped members has a long leg and a short leg, wherein said legs which are end abutted are said long legs.

12. The combination as claimed in claim 9, wherein said long legs are end abutted and said short legs face said movable armature means.

13. A shunt trip device for a circuit breaker system, comprising:

trip means interactive with separable main contacts for opening said separable main contacts;

movable latch mean interconnected with said trip means for actuating said trip means upon release;

movable armature means interactive with said movable latch means for capturing said movable latch means until said movable armature means is moved at which time said movable latch means is released;

electromagnetic means interactive with said movable armature means for moving said movable armature means when said electromagnetic means is energized, comprising;

electromagnetic toroidal coil means having a central opening;

two piece magnetic core means disposed within said central opening for being magnetized by said electromagnetic toroidal coil means for interacting with said movable armature means for moving said movable armature means;

a source of electrical power interconnected with said electromagnetic toroidal coil means upon command for magnetizing said two piece magnetic core means; and wherein said two piece magnetic core means comprises a pair of members which are end abutted at the end of a leg of each to allow assembly from both sides of said central opening.

14. A shunt trip device for a circuit breaker system, comprising:

trip means interactive with separable main contacts for opening said separable main contacts;

movable latch mean interconnected with said trip means for actuating said trip means upon release;

movable armature means interactive with said movable latch means for capturing said movable latch means until said movable armature means is moved at which time said movable latch means is released;

electromagnetic means interactive with said movable armature means for moving said movable armature means when said electromagnetic means is energized, comprising;

electromagnetic toroidal coil means having a central opening;

two piece magnetic core means disposed within said central opening for being magnetized by said electromagnetic toroidal coil means for interacting with said movable armature means for moving said movable armature means;

a source of electrical power interconnected with said electromagnetic toroidal coil means upon command for magnetizing said two piece magnetic core means; and a backing plate means which over laps both pieces of said two piece magnetic core means for providing a magnetic flux path around the jointure of said both pieces.

* * * * *